US009056328B2

(12) United States Patent
Giovannini

(10) Patent No.: US 9,056,328 B2
(45) Date of Patent: Jun. 16, 2015

(54) AIR GUN

(75) Inventor: Caterina Giovannini, Santa Maria in Fabriago-Lugo (IT)

(73) Assignee: IBIX S.R.L., Santa Maria in Fabriago-Lugo (IT)

( * ) Notice: Subject to any disclaimer, the term of this patent is extended or adjusted under 35 U.S.C. 154(b) by 203 days.

(21) Appl. No.: 13/810,047

(22) PCT Filed: Jul. 13, 2011

(86) PCT No.: PCT/EP2011/061936

§ 371 (c)(1),
(2), (4) Date: Jan. 14, 2013

(87) PCT Pub. No.: WO2012/007497

PCT Pub. Date: Jan. 19, 2012

(65) Prior Publication Data

US 2013/0112779 A1 May 9, 2013

(30) Foreign Application Priority Data

Jul. 15, 2010 (IT) ..... BO2010A0451

(51) Int. Cl.

| | |
|---|---|
| ***B05B 1/34*** | (2006.01) |
| ***B24C 5/02*** | (2006.01) |
| ***B24C 5/04*** | (2006.01) |
| ***B24C 7/00*** | (2006.01) |
| *B05B 7/14* | (2006.01) |

(52) U.S. Cl.

CPC ..... *B05B 1/341* (2013.01); *B05B 1/3447* (2013.01); *B05B 1/3415* (2013.01); *B05B 7/1481* (2013.01); *B24C 5/02* (2013.01); *B24C 5/04* (2013.01); *B24C 7/0046* (2013.01); *B24C 7/0069* (2013.01)

(58) Field of Classification Search

CPC .... B05B 1/341; B05B 1/3447; B05B 1/3415; B05B 7/1481; B24C 5/02; B24C 5/04; B24C 7/0046; B24C 7/0069

USPC ..... 239/380–383, 487, 488, 489, 500, 501

See application file for complete search history.

(56) References Cited

U.S. PATENT DOCUMENTS

| | | | | |
|---|---|---|---|---|
| 2,086,074 | A * | 7/1937 | Del Genovese | 239/465 |
| 3,237,865 | A * | 3/1966 | Kovach | 239/142 |
| 3,344,558 | A | 10/1967 | Kirkland | |
| 5,885,351 | A | 3/1999 | Long et al. | |
| 6,050,504 | A | 4/2000 | Schultz et al. | |

FOREIGN PATENT DOCUMENTS

| | | | |
|---|---|---|---|
| CN | 2332492 | Y | 8/1999 |
| DE | 202 19 885 | U1 | 4/2004 |
| EP | 0 691 183 | A1 | 1/1996 |
| FR | 2 583 310 | A3 | 12/1986 |
| GB | 1 270 452 | A | 4/1972 |
| JP | 4145229 | A | 5/1992 |

* cited by examiner

*Primary Examiner* — Christopher Kim

(74) *Attorney, Agent, or Firm* — McGlew and Tuttle, P.C.

(57) ABSTRACT

The air gun comprises a substantially cylindrical-shaped external case (2), provided at one end with a connection element (8) suitable to enable the connection of the air gun (1) with a device for supplying a fluid to be sprayed, and provided at the opposite end with an expulsion device (10) suitable to enable the outlet of the fluid to be sprayed towards the outside. Inside the case (2) is arranged a vortex generator device (9) provided with a plurality of internal walls (91) having curvilinear profiles. The walls (91) define a plurality of separated helical pipes (93), in order to give the fluid to be sprayed a helical rotatory motion.

7 Claims, 1 Drawing Sheet

AIR GUN

TECHNICAL FIELD

The present invention regards an air gun, in particular a vortex generator gun.

BACKGROUND ART

Using air guns for cleaning stony surfaces, wooden handmade articles, or items of the historical or modern architecture made of natural or artificial materials has been known for a while. Such guns spray a fluid, generally air or air mixed with abrasive powders, on the surface to be cleaned so as to remove the undesired stratifications and deposits, such as, for example, graffiti.

A problem which occurs when using such guns stands in the fact that, spraying a fluid through a direct jet, the power of such jet is difficult to dose and often results too weak, performing an insufficient cleaning of the wall to be cleaned, or otherwise results too powerful, performing a cleaning which is not very selective and triggering an alteration of the surface to be cleaned. To overcome such a problem, is also known the use of vortex generator air guns, suitable to spray the fluid through a jet having a helical motion.

As an example, U.S. Pat. No. 6,050,504 discloses a spray dispensing device which comprises passageways for directing streams of air and liquid, where the liquid is broken up into droplets and emitted as a fine spray through an orifice. An annular air passageway is arranged concentrically disposed around a liquid passageway. The air is led through swirl-shaped passages, where a rotary motion is imparted to the annular air stream.

Patent application JP 4145229 shows a vortex flow generator for a gas, wherein a high pressure air stream is injected into a gas stream. The high pressure air stream is inclined at a constant angle with respect to the axis of gas stream, and is jetted from a direction focused out of the axis of the gas stream. The velocity of high pressure air is therefore provided with a vector component in the direction of the axis of the gas flow, and with a vector component in the direction intersecting the gas flow, so that the air is emitted with a turning effect, forming a vortex. Nevertheless such a vortex flow generator is not suited to be arranged in a gun, but in the supply device to which the gun is connected.

The proposed solutions do not form practical applications for the users, because they turn out to be complicated to assemble, or because they perform the formation of the vortex before the air enters the gun, thus determining the at least partial loss of the vortex effect when the fluid is sprayed.

Utility model CN 2332492 Y shows an air gun comprising an electrostatic pipe, an inner shaft, an outer sleeve, a dual flow distribution assembly, a fixed seat and a spray head suitable to spray a mixture of air and powder. The electrostatic pipe is provided with a flow distribution groove whose inner surface presents a spiral concave shape, such that the vortex air stream, quickly turning, moves the flow distribution groove, and causes the flow distribution groove to be rubbed with the wall of the electrostatic pipe. Such a rubbing makes the outer wall of the inner shaft generate electricity which modifies the electrostatic charge of the powder in a way as to improve the coating effect. Yet, such a device has a scarce efficiency in that it gives a rotary motion only to a part of the fluid which crosses it.

DISCLOSURE

The task of the present invention is that of solving the aforementioned problems, devising an air gun that allows to spray in an efficient manner a fluid vortex.

Within such task, it is a further scope of the present invention that of providing an air gun easy to assemble.

A further object of the present invention is that of providing an air gun having a simple conception, a securely reliable functioning and versatile use, as well as relatively economic cost.

The above mentioned scopes are attained, according to the present invention, by the air gun according to claim 1.

The air gun comprises a vortex generator device provided with a plurality of internal walls having curvilinear profiles, arranged in a way as to de fine a plurality of separated helical pipes, in order to give the fluid to be sprayed a helical rotatory motion.

Suitably, the vortex generator device comprises an axial column about which there are angularly distributed the aforesaid internal walls having curvilinear profiles, connected to the column according to substantially tangential directions.

The presence of the separated helical pipes allows to give the totality of the fluid to be sprayed a helical rotatory motion.

DESCRIPTION OF DRAWINGS

Details of the invention shall be more apparent from the detailed description of a preferred embodiment of the air gun according to the invention, illustrated for indicative purposes in the attached drawings, wherein.

BEST MODE

Figure 1:
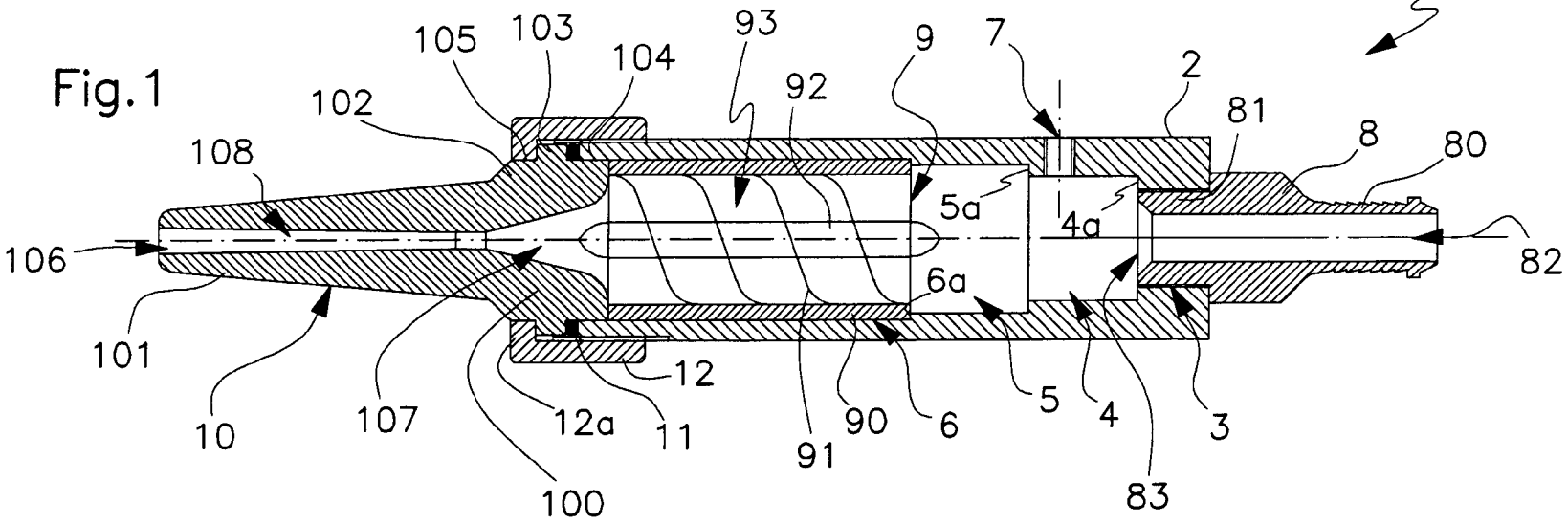
FIG. 1 shows a longitudinal section view of the gun in hand.

With particular reference to such figures, the air gun according to the invention is indicated in its entirety with 1. The gun is suitable to be connected to a hose exiting from a device for supplying the fluid to be sprayed, not represented in the drawings.

The air gun 1 comprises an external case 2, such as for example a short tube, having a substantially cylindrical shape and open at both ends.

At a first end, the short tube 2 contains axially an inlet chamber 3 for the fluid to be sprayed, which is connected to a second chamber 4 having a diameter slightly greater than the diameter of the inlet chamber 3. The second chamber 4 is connected to a third chamber 5 having a diameter greater than the diameter of the second chamber 4. Such a third chamber 5 comes out at a forth chamber 6 having a diameter slightly greater than the diameter of the third chamber 5, and extending substantially from a central zone of the short tube 2 until the end opposite to the inlet chamber 3. It is to be noted that the aforesaid chamber 3, 4, 5, 6 are arranged in sequence and coaxial to one another; the edge between two consecutive chambers shapes respective shoulders 4*a*, 5*a*, 6*a*, which is due to the differences of diameter between two consecutive chambers (see FIG. 1).

Preferably, the external case 2 is provided with at least a radial opening 7 obtained at the second chamber 4, suitable to enable the introduction of at least a possible auxiliary fluid, such as for example water, air, or a mixture of water and air in any proportions, inside the second chamber 4, in a way as to mix such a possible auxiliary fluid with the fluid to by sprayed, in order to improve the performances thereof according to the specific exigencies.

The gun 1 comprises a connection element 8 suitable to be inserted axially in the inlet section 3 of the external body 2. The connection element 8 has a substantially cylindrical shape and is open at both ends. Preferably, the connection element 8 is provided with an external connection portion 80 suitable to be inserted in a tube, such as for example the aforesaid outlet hose of a device for supplying the fluid to be sprayed. The opposite end of the connection element 8 defines an internal connection portion 81 having an external diameter substantially equal to the diameter of the inlet chamber 3 of the short tube 2, in a way as to enable the insertion thereof in the same inlet chamber 3. The connection element 8 comprises an internal duct 82 extended axially on its whole length so as to allow the passage of the fluid to be sprayed. Preferably, the internal duct 82 has a frusto-conical shaped outlet portion 83, arranged in a way as to present an opening having a diameter greater than the duct 82.

Figure 2:
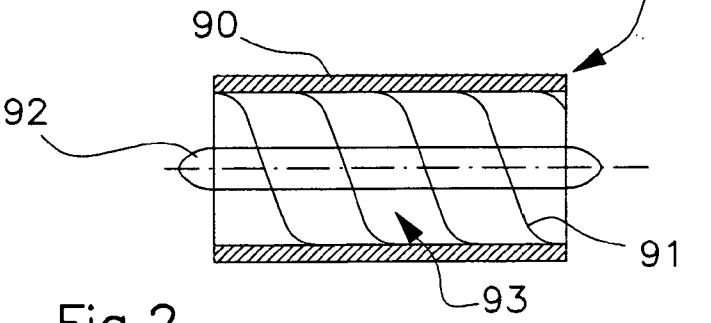
FIG. 2 shows a longitudinal section view of a detail of the gun in hand.

The air gun 1 is provided with a vortex generator device 9 suitable to be arranged inside the short tube 2, at the forth chamber 6, in particular abutting against the shoulder 6*a*. Such a vortex generator device preferably consists of a helical sleeve (FIGS. 1, 2 and 3).

The helical sleeve 9 comprises a cylindrical body 90 having an external diameter substantially equal to the diameter of the forth chamber 6, to enable the insertion of the sleeve 9 in position coaxial to the same forth chamber 6. The helical sleeve 9 has a plurality of internal walls 91 connected on one side to the internal surface of the cylindrical body 90, and on the other side to an axial column 92 arranged at the axis of the cylindrical body 90. The internal walls 91 have a curvilinear section profile, as shown in FIG. 3, and extend between both ends of the cylindrical body 90 according to a helical trajectory about the axial column 92, as can be seen in FIGS. 1 and 2.

The internal walls 91 are angularly distributed about the axial column 92 and allow to define as many separated helical pipes 93, suitable to enable the passage of the fluid to be sprayed, possibly mixed with the auxiliary fluid, and, at the same time, to give the fluid a helical rotatory motion so as to generate a vortex stream. Preferably, the helical sleeve 9 comprises four internal walls 91, so defining four helical pipes 93. Nevertheless it is possible to provide any number of internal walls 91 that allow to shape a plurality of helical pipes 93, to enable an easy passage of the fluid to be sprayed.

Figure 3:
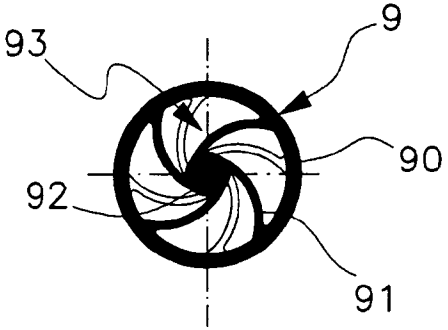
FIG. 3 shows a transverse section view of the detail of FIG. 2.

It is to be noted that the curvature of the section profile of the internal walls 91 of the helical sleeve 9 is such as to allow the said internal walls 91 to be connected to the axial column 92 according to a direction substantially tangential to the same column, in a way as to define helical pipes 93 having substantially triangular section profiles with curvilinear sides, two of the sides being convex, and the third side being concave, in such a way that said triangles placed side by side shape a discoid profile (FIG. 3).

It is to be noted that in the illustrated example, the length of the axial column 92 of the vortex generator device 9 is greater than the length of the cylindrical body 90, both ends of the axial column 92 protruding from the cylindrical body and having a substantially semi-spherical shape. It is also to observe that the axial column 92 has a suitable diameter such that also the zone of the helical pipes 93 closest to the axis of the helical sleeve 9 shapes a sufficiently helical path to give the totality of the fluid the desired helical rotatory motion.

The length of the cylindrical body 90 of the helical sleeve 9 is preferably shorter than the length of the forth chamber 6 of the external body 2, in a way as to enable the insertion, in the free end of the same, of a vortex expulsion device 10, preferably consisting of a nozzle. The nozzle 10 comprises a connection portion 100, suitable to warrant the tight connection of the nozzle 10 to the gun 1, having a substantially cylindrical external shape, and an end portion 101 having a lengthened frusto-conical shape, connected to each other by an intermediate portion 102 having a flattened frusto-conical external shape.

The connection portion 100 is provided, in a substantially central zone, with an annular abutment element 103 having a rectangular section profile, as can be seen in FIG. 1. The abutment element 103 delimits an insertion portion 104 between the free end of the connection portion 100 and the abutment element 103 and suitable to be inserted in the forth chamber 6 of the external body 2, and a blocking portion 105 arranged between the abutment element 103 and the intermediate portion 102 of the nozzle 10.

The expulsion device 10 is further provided with an internal pipe 106 provided with a bell shaped section 107, arranged inside the connection portion 100 and the intermediate portion 102, and with a frusto-conical section 108 arranged inside the end portion 101. The bell shaped section extends from the free end of the connection portion 100, at which the internal pipe 106 has its larger diameter, decreasing until the limit between the intermediate portion 102 and the end portion 101, at which the internal pipe 106 has its smaller diameter. The frusto-conical section 108 extends from the said limit until the end of the end portion 101, its diameter increasing progressively until the said end.

The air gun 1 has tight means 11, such as for example a washer, inserted in use about the connection portion 100 and abutting against the abutment element 103 of the nozzle 10, so as to warrant the tight sealing between the nozzle 10 and the external body 2. The nozzle 10 is maintained at the end of the external body 2 through a suitable closing member 12, preferably consisting of a substantially cylindrical-shaped closing ring nut. Such a ring nut 12 is provided with an annular edge 12*a* suitable to be inserted about the blocking portion 105 of the connection portion 100 in a way as to engage the abutment element 103, while the ring nut 12 is connected to the external side of the external body 2 (FIG. 1).

The assembling and the functioning of the air gun 1 turn out to be easy to understand from the preceding description.

First of all one provides to insert the internal connection portion 81 of the connection element 8 in the inlet chamber 3 of the short tube 2. Thereafter, the helical sleeve 9 is inserted in the forth chamber 6 of the short tube 2, and arranged abutted against the shoulder 6*a* delimiting the same forth chamber 6 with respect to the third chamber 5. The insertion portion 104 of the nozzle 10, equipped with the washer 11 arranged as previously described, is then inserted in the free end of the short tube 2. It is to be noted that the length of such an insertion portion 104 and the thickness of the washer 11 are such that, in use, the end of the insertion portion 104 comes to be substantially in contact with the end of the cylindrical body 90 of the helical sleeve 9 inside the forth chamber 6 of the short tube 2.

The nozzle is then blocked and tightened by means of the closing ring nut 12. Such blocking allows to perform a triple tight sealing, between one end of the helical sleeve 9 and the shoulder 6*a*, between the opposite end of the helical sleeve 9 and the end of the connection portion 100 of the nozzle 10, and by means of the washer 11 arranged between the abutment element 103 and the end of the short tube 2.

After the insertion of the external connection portion 80 of the connection element 8 in a suitable hose exiting from a device for supplying the fluid to be sprayed, the fluid is passed under pressure in the internal duct 82 of the connection element 8. Out from the duct 82, the fluid enters the second chamber 4 inside the short tube 2, at which an auxiliary fluid is possibly injected through the radial opening 7, as previously described, to refine or improve the properties of the fluid to be sprayed. In such a case, the mixture of both the aforesaid fluids occurs immediately in the second chamber 4 and in the third chamber 5 inside the short tube 2.

The fluid to be sprayed, possibly mixed with the auxiliary fluid, enters successively the third chamber 5 and the helical pipes 93 of the helical sleeve 9. The path through the helical sleeve 9 imparts to the pressurized fluid a helical rotatory motion.

Such helical rotatory motion of the fluid to be sprayed continues while the fluid enters the bell shaped section 107, and then in the frusto-conical section of the internal pipe 106 of the nozzle 10, until the outlet of the fluid from the same nozzle 10.

The described air gun therefore attains the scope of spraying in an efficient way a fluid vortex. Such a result is obtained in particular thanks to the inventive idea of arranging a helical sleeve 9, provided with a plurality of helical pipes 93, inside the body 2 of the gun 1, close to the nozzle 10. The presence of the helical sleeve 9 allows to impart the whole fluid to be sprayed a helical rotatory motion.

A characteristic of the air gun in hand consists in the fact that it results simple and easy to assemble.

In practice, the embodiment of the invention, the materials used, as well as the shape and dimensions, may vary depending on the requirements.

Should the technical characteristics mentioned in each claim be followed by reference signs, such reference signs were included strictly with the aim of enhancing the understanding the claims and hence they shall not be deemed restrictive in any manner whatsoever on the scope of each element identified for exemplifying purposes by such reference signs.

The invention claimed is:

1. An air gun, comprising:

a substantially cylindrical-shaped external case, provided at one end with a connection element suitable to enable a connection of said air gun with a device for supplying a fluid to be sprayed, and said external case provided at an opposite end with an expulsion device suitable to enable an outlet of said fluid to be sprayed towards an outside; and a vortex generator device arranged inside said external case and provided with a plurality of internal walls having curvilinear profiles, arranged in a way as to define a plurality of separated helical pipes, to give said fluid to be sprayed a helical rotatory motion, said separated helical pipes having a substantially triangular section profile with curvilinear sides, two of the curvilinear sides being convex, and a third of said curvilinear sides being concave, such that triangles placed side by side shape a discoid profile, said vortex generator device comprising a cylindrical body and an axial column, arranged at an axis of said cylindrical body, said plurality of internal walls being angularly distributed about said axial column and said plurality of internal walls being connected to said axial column according to substantially tangential directions, said axial column having a diameter such that a most internal portion of said helical pipes shapes a helical path, so as to give a totality of said fluid to be sprayed a helical rotatory motion, said vortex generator device being interposed and blocked in a seat between a shoulder inside said external case and said expulsion device, so that said helical rotatory motion given to said fluid to be sprayed by said vortex generator device is maintained while said fluid to be sprayed enters inside said expulsion device.

2. An air gun according to claim 1, wherein said plurality of internal walls comprises four said internal walls.

3. An air gun according to claim 1, further comprising:

a closing member suitable to tighten said expulsion device against said vortex generator device and against said external case so as to operate a tight sealing between said vortex generator device and said shoulder, between said vortex generator device and said expulsion device, and between said expulsion device and said external case through an interposition of a tightening means.

4. An air gun according to claim 3, wherein said expulsion device comprises an annular abutment element suitable to be engaged by said closing member in order to tighten said expulsion device against said vortex generator device and said external case.

5. An air gun according to claim 3, wherein said plurality of internal walls comprises four said internal walls.

6. An air gun according to claim 1, wherein said expulsion device comprises an internal pipe, said internal pipe comprising a first segment having a bell shaped section and a second segment having a frusto-conical section, suitable to maintain said helical rotatory motion given to said fluid to be sprayed by said vortex generator device while said fluid to be sprayed is passed through said internal pipe.

7. An air gun, comprising:

a substantially cylindrical-shaped external case, provided at one end with a connection element suitable to enable a connection of said air gun with a device for supplying a fluid to be sprayed, and said external case provided at an opposite end with an expulsion device suitable to enable an outlet of said fluid to be sprayed towards an outside; and a vortex generator device arranged inside said external case and provided with a plurality of internal walls having curvilinear profiles, arranged in a way as to define a plurality of separated helical pipes, to give said fluid to be sprayed a helical rotatory motion, said separated helical pipes having a substantially triangular section profile with curvilinear sides, two of the curvilinear sides being convex, and a third of said curvilinear sides being concave, such that triangles placed side by side shape a discoid profile, said vortex generator device comprising a cylindrical body and an axial column, arranged at an axis of said cylindrical body, said plurality of internal walls being angularly distributed about said axial column and said plurality of internal walls being connected to said axial column according to substantially tangential directions, said axial column having a diameter such that a most internal portion of said helical pipes shapes a helical path, so as to give a totality of said fluid to be sprayed a helical rotatory motion, said expulsion device comprising an internal pipe, said internal pipe comprising a first segment having a bell shaped section and a second segment having a frusto-conical section, suitable to maintain said helical rotatory motion given to said fluid to be sprayed by said vortex generator device while said fluid to be sprayed is passed through said internal pipe.

* * * * *